US007222427B1

(12) United States Patent
Kaidi et al.

(10) Patent No.: US 7,222,427 B1
(45) Date of Patent: May 29, 2007

(54) NAIL CLIPPER

(76) Inventors: Alexandre Rachid Kaidi, 6 Valencia St. #4, San Rafael, CA (US) 94901; Spencer Phillip Kaidi, 6 Valencia St. #4, San Rafael, CA (US) 94901

( * ) Notice: Subject to any disclaimer, the term of this patent is extended or adjusted under 35 U.S.C. 154(b) by 0 days.

(21) Appl. No.: 11/226,811

(22) Filed: Sep. 13, 2005

(51) Int. Cl.
*A45D 29/02* (2006.01)

(52) U.S. Cl. ..... 30/28; 30/125; 132/75.5

(58) Field of Classification Search ..... 30/26, 30/27, 28, 124, 125; 132/75, 75.3, 75.4, 132/75.5
See application file for complete search history.

(56) References Cited

U.S. PATENT DOCUMENTS

| | | | | | |
|---|---|---|---|---|---|
| 796,389 | A * | 8/1905 | Wright | 132/75.5 |
| 4,130,937 | A * | 12/1978 | Kim | 30/28 |
| 4,341,015 | A * | 7/1982 | Young | 30/28 |
| 4,519,134 | A * | 5/1985 | Bumbera | 30/28 |
| 4,550,496 | A * | 11/1985 | Reinicke | 30/124 |
| 4,614,031 | A * | 9/1986 | Chen | 30/28 |
| 4,847,994 | A * | 7/1989 | Dunn, Jr. | 30/28 |
| 5,195,544 | A * | 3/1993 | Campagna | 132/75.5 |
| 5,488,772 | A * | 2/1996 | Dababneh et al. | 30/28 |
| 5,634,275 | A * | 6/1997 | Pine | 30/145 |
| 6,088,919 | A * | 7/2000 | Gilman | 30/28 |
| 2004/0098861 | A1* | 5/2004 | Novellie et al. | 30/28 |
| 2004/0148779 | A1* | 8/2004 | Choi et al. | 30/28 |

FOREIGN PATENT DOCUMENTS

JP 10-211016 * 8/1998

* cited by examiner

*Primary Examiner*—Hwei-Siu Payer
(74) *Attorney, Agent, or Firm*—Dergosits & Noah LLP

(57) ABSTRACT

An apparatus for cutting toenails and fingernails includes a sleeve that extends over a pair of blades that are each attached to a first end of a first and second member, respectively. The first and second members are attached at an opposite second end thereof and provide a spring action intermediate the first and second members sufficient to urge the blades away from each other. A lever is attached to the sleeve proximate the first end of the first and second members and is adapted to pivot about an axis to urge the first end of the first and second members towards each other for cutting nails.

10 Claims, 1 Drawing Sheet

NAIL CLIPPER

BACKGROUND OF THE INVENTION

1. Field of the Invention

The present invention, in general, relates to personal grooming devices and, more particularly, to toe and finger nail clippers.

Nail clippers, the term herein including either toe or finger nail type of clippers, are generally well known.

Nail clippers have certain problems. For example, prior art designs tend to spray the clippings into a room. The clippings may be sharp and can even spread infection. Therefore, it is desirable to contain clippings.

However, prior art nail clippers include a center post that engages with a pivoting lever. The pivoting lever, pressing upon a ridge in the center post applies pressure to the clipper sufficient to urge a pair of opposite sides, and therefore also the blades, toward one-another during use.

The center post, though necessary, provides an obstruction that certain of the clippings inevitably must impact. The clippings bounce off of the center post and are scattered. Any prior art type of modification intended to retain the clippings has proven to be ineffective when they are bouncing off of the center post.

Other prior-art types of nail clippers do not fold sufficiently flat for storage. Others do not apply leverage that can create sufficient force to cut through difficult nails without requiring a great deal of force by the user.

Accordingly, there exists today a need for a nail clipper that helps ameliorate the above-mentioned and other difficulties.

Clearly, such an apparatus would be a useful and desirable device.

2. Description of Prior Art

Nail clippers are, in general, known. While the structural arrangements of the above described known types of devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a nail clipper that does not include a center post.

It is also an important object of the invention to provide a nail clipper that is inexpensive to manufacture.

Another object of the invention is to provide a nail clipper that includes sufficient mechanical advantage (i.e., leverage).

Still another object of the invention is to provide a nail clipper that is aesthetically attractive.

Still yet another object of the invention is to provide a nail clipper that includes a sleeve.

Yet another important object of the invention is to provide a nail clipper that includes a sleeve and a pivoting lever, the lever being pivotally attached to the sleeve.

Still yet another important object of the invention is to provide a nail clipper that captures and retains clippings therein.

A first continuing object of the invention is to provide a nail clipper that includes a sleeve that extends the entire longitudinal length of the clipper sufficient to capture and retain clippings therein.

A second continuing object of the invention is to provide a nail clipper that includes a pivoting lever that is adapted to pivot into a first position that is disposed over a first member for cutting and into a second position that is disposed adjacent to a second member for storage and transport.

Briefly, a nail clipper that is constructed in accordance with the principles of the present invention has a sleeve that extends over a pair of facing cutting blades that are each attached to a first end of a first and second member, respectively, and wherein the first and second members are each joined together at a second end that is disposed at an opposite end with respect to the blades. A spring action inherent to the first and second members permits the blades to move toward and away from each other. In a normal quiescent state, the spring action urges the two blades a predetermined distance apart that is sufficient for a portion of a toe nail or a finger nail to enter. A lever is attached to the sleeve proximate the first end of the first and second members and is adapted to pivot about an axis. When the lever is pivoted over the first member and urged toward it, it contacts a portion of the first member and urges the first member toward the second member sufficient to bring a cutting edge of the two blades into contact with each other sufficient to cut a toe nail or a finger nail. When the lever is pivoted over the second member and adjacent to it, it folds flat for storage and transport.

DETAILED DESCRIPTION OF THE INVENTION

Figure 3:
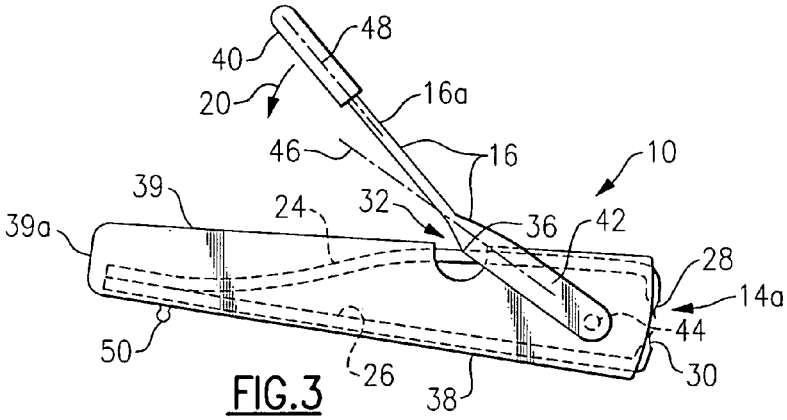
FIG. 3 is a side view of the sleeve of FIG. 2 disposed over the interior nail clipper portion of FIG. 1 with a pivoting lever disposed over a first member, ready for cutting.

Referring to all of the drawing figures and now initially to FIG. 3 is shown, a nail clipper, identified in general by the reference numeral 10.

Figure 1:
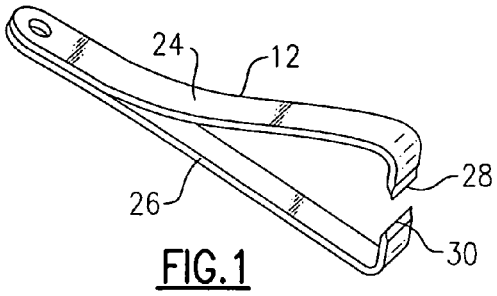
FIG. 1 is a view in perspective of an interior nail clipper portion.
Figure 2:
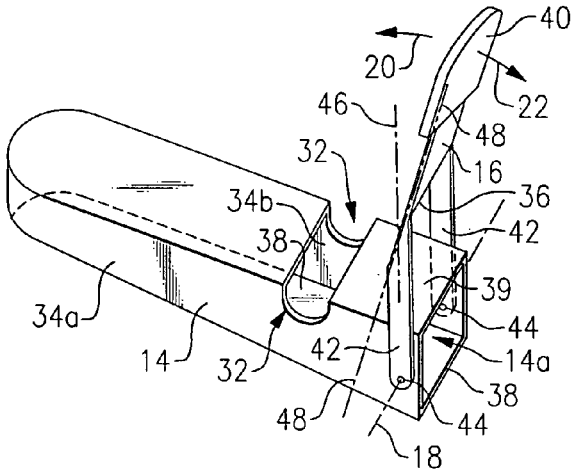
FIG. 2 is a view in perspective of an exterior sleeve and a pivoting lever.

Referring now also to FIG. 1 and FIG. 2, the nail clipper 10 includes an interior nail clipper portion 12 (FIG. 1) and an exterior sleeve 14 and a pivoting lever 16 (FIG. 2) that is pivotally attached to the sleeve 14 on opposite sides and adapted to pivot about an axis 18 in a first direction as shown by arrow 20 or in an opposite second direction, as shown by arrow 22.

The interior nail clipper portion 12 and the sleeve 14 and lever 16 are shown apart in FIG. 1 and FIG. 2 to better illustrate the construction of each. When properly assembled, the sleeve 14 is disposed over the interior nail clipper portion 12, as shown in FIG. 3.

The nail clipper portion 12 includes an upper first member 24 and a lower bottom second member 26.

An upper cutting blade 28 includes an arcuate edge and is attached to a first end of the first member 24 at approximately a right-angle with respect to a longitudinal axis of the first member 24.

A lower cutting blade 30 includes an arcuate edge that corresponds with that of the upper cutting blade 28. The lower cutting blade 30 is attached to a first end of the second member 26 at what approximately a right-angle with respect to a longitudinal axis of the second member 26.

Together, the upper cutting blade 28 and the lower cutting blade 30 forms a pair of cutting blades that align with and face each other.

The first member 24 and the second member 26 are attached to each other at a second end thereof that is disposed at an opposite end with respect to the cutting blades 28, 30. Attachment can be by spot welding, adhesive, or by any other preferred method.

The first member 24, second member 26, and cutting blades 28, 30 are similar to existing prior art types of nail clippers (not shown) except the current first and second members 24, 26, as described, do not include any attached lever mechanism that can urge the cutting blades 28, 30 toward each other, as is common with the prior art types of nail clippers. Accordingly, there is no center post, common with prior art designs that include the attached lever mechanism.

The first and second members 24, 26 are either formed of a material, such as spring steel, or otherwise are provided with a spring action with respect to the first and second members 24, 26. The spring action, in a normal quiescent state, urges the two blades 28, 30 a predetermined distance apart from each other that is sufficient for a portion of a toenail or a fingernail (not shown) to enter between the blades 28, 30 for cutting. The spring action also permits the blades 28, 30 to move toward and away from each other when a force is applied that is sufficient to do so.

Referring again to all of the drawings and in particular to FIG. 3, the sleeve 14 is formed of plastic, graphite, fiberglass, metal, or any other preferred material or combination of materials having sufficient strength and durability. The sleeve 14 includes an open end 14*a* that is disposed over the blades 28, 30 when the nail clipper 10 is properly assembled.

The sleeve 14 includes an upper opening, identified in general by the reference numeral 32, that extends across an upper or top surface member 39 of the sleeve 14 and which includes a longitudinal axis that is parallel with the axis 18 of the lever 16. Other than the upper opening 32 and the open end 14*a*, the remainder of the sleeve 14 is enclosed. This is to optimally retain any nail clippings that may enter therein, as is described in greater detail hereinafter.

The upper opening 32 includes a predetermined width and it extends down into a pair of spaced-apart opposite sidewalls 34*a*, 34*b* of the sleeve 14 an amount sufficient to allow an edge 36 of the lever 16 to contact the upper surface of the first member 24 and, when the lever 16 is further urged in the direction shown by arrow 20, to force the first member 24 sufficiently far down and toward the second member 26 so that the cutting blades 28, 30 make contact with each other.

A bottom surface 38 of the sleeve 14 is attached to the sidewalls 34*a*, 34*b* and it supports the second member 26 so that the second member 26 cannot be urged away from the first member 24 when the lever 16 is urged in the direction of arrow 20.

When the cutting blades 28, 30 make contact with each other, any portion of any finger nail or toe nail, as may be disposed between the two blades 28, 30 is severed when sufficient force is applied so that the blades are forced into contact with each other. When force upon the lever 16 is removed, the spring action of the two members 24, 26 urges the blades 28, 30 apart. The maximum distance the two members 24, 26 and therefore also the blades 28, 30 can extend apart from one another is further limited by distance between the bottom surface 38 and the upper, top surface 39 of the sleeve 14 should the spring action attempt to further separate them.

The top surface 39 is attached to the sidewalls 34*a*, 34*b*. A rear member 39*a* is attached to the bottom surface 38, the top surface 39, and to the sidewalls 34*a*, 34*b* sufficient to provide the desired amount of enclosure.

The nail clipper 10 includes a mechanical advantage that is a function of the distance from the edge 36 of the lever 16 along a planar member portion 16*a* of the lever 16 to a finger pad 40 that is disposed on a distal end of the planar member portion 16*a* of the lever 16 with respect to the axis 18 as compared to the distance from the axis 18 to the edge 36. The greater the first dimension as compared to the second dimension, the greater is the mechanical advantage. During use, a finger (not shown) is placed on the finger pad 40 and force is applied until a portion of the finger nail or toe nail has been severed.

The distance from the axis 18 along a longitudinal length of a pair of side members 42 that are disposed on opposite sides of the sleeve 14 and extending to the edge 36 is kept short while the remaining length of the lever 16 is kept long, but not so long that when it is folded, as is described in greater detail hereinafter, it exceeds the length of the sleeve 14. Accordingly, great mechanical advantage is provided that makes use of the nail clipper 10 especially easy to accomplish.

At the axis 18, each of the side members 42 includes a pin 44 that extends inward, toward a longitudinal center of the nail clipper 10. Each pin 44 is disposed in a hole that is provided in each of the sidewalls 34*a*, 34*b*. When the lever 16 pivots in the direction of arrow 20 or arrow 22, the pins 44 rotate about the axis 18 in the holes that are disposed in the sidewalls 34*a*, 34*b*.

The lever 16 is especially easy to manufacture. It is preferably formed from flat stock, for example, a metallic stock. The side members 42, which initially extend at an angle away from a center longitudinal axis of the lever 16, are then bent into the position shown. This provides exceptional strength for the lever 16 when force is applied in the direction of arrow 20 while minimizing weight of the lever 16 and the cost of its manufacture.

This configuration also provides two unexpected benefits. Intermediate the edge 36 and the axis 18, the lever 16 includes an opening that is large enough to permit the lever 16 to be urged in the direction of arrow 22 sufficient to permit it to pass over the blades 28, 30 and to contact an exterior of the bottom surface 38.

Accordingly, the lever 16 is disposed on one side of the nail clipper 10 for cutting and on the other side for storage and transport. As an easy pivoting of the lever 16 about the axis 18 is all that is required to accomplish this change, it is surprisingly easy to convert the nail clipper 10 from a first position adapted for cutting into a second position adapted for storage when compared to the complex motions that the attached lever mechanism of prior art designs must undergo in order to move them from a storage position into a cutting position an back again.

Figure 4:
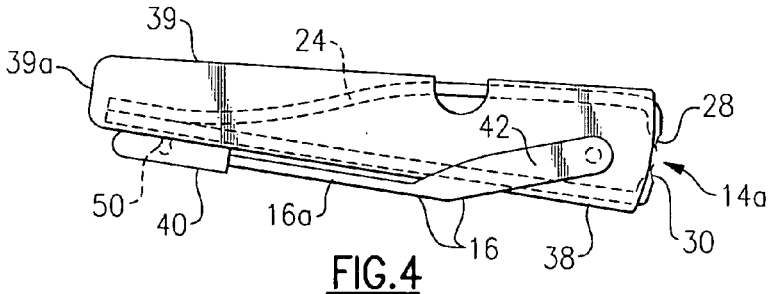
FIG. 4 is a side view of the sleeve of FIG. 2 disposed over the interior nail clipper of FIG. 1 with a pivoting lever disposed adjacent to a second member, ready for transport or storage.

A second benefit, as shown in FIG. 4, is that the geometry of the lever 16 provides an unusually flat and compact storage position for the nail clipper 10.

Referring to FIG. 3 also, a side member longitudinal axis 46 forms an acute angle with respect to a lever longitudinal axis 48. When the lever 16 is in a first position, adapted for cutting, this angle elevates the finger pad 40 a sufficient distance above the top surface 39 to permit a full range of motion along the direction shown by arrow 20 to cut the finger or toe nail with the desired amount of mechanical advantage.

However when the lever 16 is pivoted in the direction of arrow 22 fully around so that it is adjacent to the bottom member 26, this same geometry (acute angle) ensures that as soon as the edge 36 is disposed below the bottom surface 38, the remainder of the lever 16 changes direction so that it is flush with the bottom surface 38. This provides especially compact storage and transport position.

If desired, a small protrusion 50 is attached to and extends from the bottom surface 38. The protrusion 50 may include an enlarged end. When the lever 16 is disposed in the second position (FIG. 4), the protrusion 50 engages with and enters into a corresponding opening that is provided in the finger pad 40. This secures the lever 16 in the second position until a force sufficient to disengage the protrusion 50 from the opening in the finger pad 40 is applied to the lever 16.

During use, as the blades 28, 30 approach each other they start to cut through a portion of the finger nail or toe nail. As the nail is about to be severed, the rate of approach suddenly increases as resistance by the nail diminishes. This causes a snapping sound and impels the nail clipping with force and velocity rearward and into the sleeve 14 where it is captured. Because there is no post, the clippings cannot be reflected off of the post and out the sides.

Nail clippings are sharp and can injure people when they travel with velocity. The nail clipper 10 not only captures virtually every nail clipping within the sleeve 14, but also absorbs the kinetic energy of the nail clippings, thereby ensuring that they are not expelled from the nail clipper 10 and deposited on the floor or elsewhere.

Because the nail clipper 10 also prevents ricochets and other projectile nail clippings, it is therefore also safer to use than prior art types of designs.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A nail clipper, comprising:

(a) a first member and a first cutting blade attached to a first end of said first member;

(b) a second member and a second cutting blade attached to a first end of said second member, and wherein said first member and said second member are attached at a second end of said first member and said second member;

(c) wherein said first cutting blade and said second cutting blade each include a sharp edge and wherein said sharp edges face each other and are normally disposed a predetermined distance apart from each other;

(d) a sleeve that includes opposite spaced-apart sidewalls, an upper surface intermediate said sidewalls and connected thereto, a lower surface spaced apart from said upper surface and intermediate said sidewalls and connected thereto, said upper surface and said lower surface each terminated at a front end a rear member that is attached to said sidewalls and a rear end of said upper surface and a rear end of said lower surface, and wherein said sleeve includes an open front defined by the spaced-apart sidewalls, the front end of the lower surface and the front end of the upper surface, wherein the front end of the lower surface is substantially aligned with the front end of the upper surface and wherein said sleeve is disposed over said first member and said second member and wherein said second ends of said first member and said second member are disposed proximate said rear member of said sleeve and wherein said open front of said sleeve is disposed proximate said first ends of said first member and said second member; and (e) a lever attached to said sleeve, said lever adapted to pivot about an axis with respect to said first member and said second member.

2. The nail clipper of claim 1 wherein said lever is adapted to pivot into a first position wherein a portion of said lever is disposed over said first member.

3. The nail clipper of claim 2 wherein said sleeve includes an upper opening in said upper surface proximate said first member and spaced from the front end of the upper surface, and wherein when said lever is disposed in said first position, a portion of said lever is adapted to contact said first member when said lever is urged in a first direction.

4. The nail clipper of claim 3 wherein said lever includes a pair of spaced-apart side members that are pivotally attached at a first end thereof to said sleeve at said axis, and an edge that is disposed intermediate a second end of said side members, and wherein said edge is adapted to contact said first member when said lever is urged in said first direction.

5. The nail clipper of claim 4 wherein said side members include a side-member longitudinal axis and wherein said lever includes a planar member portion that extends from said edge to a distal end of said lever that is disposed away from said side-member longitudinal axis and wherein said planar member portion includes a planar member longitudinal axis, and wherein an acute angle is formed between said side-member longitudinal axis and said planar member longitudinal axis.

6. The nail clipper of claim 5 wherein said lever is adapted to pivot in an opposite second direction and into a second position where said planar member portion is disposed proximate said second member.

7. The nail clipper of claim 4 wherein said first end of each of said spaced apart side members of said lever includes means for pivotally engaging to said sleeve.

8. The nail clipper of claim 7 wherein said means for pivotally engaging includes a pin attached to each of said side members, each of said pins adapted to engage with a hole provided in said sleeve.

9. The nail clipper of claim 5 including a finger pad that is attached to said planar member portion at a distal end of said planar member portion with respect to said side-member longitudinal axis.

10. A nail clipper, comprising:

(a) a first member and a first cutting blade attached to a first end of said first member;

(b) a second member and a second cutting blade attached to a first end of said second member, and wherein said first member and said second member are attached at a second end of said first member and said second member;

(c) wherein said first cutting blade and said second cutting blade each include a sharp edge and wherein said sharp edges face each other and are normally disposed a predetermined distance apart from each other;

(d) a sleeve that includes opposite spaced-apart sidewalls, an upper surface intermediate said sidewalls and connected thereto, a lower surface spaced apart from said upper surface and intermediate said sidewalls and connected thereto, a rear member that is attached to said sidewalls and said upper surface and said lower surface, and wherein said sleeve includes an open front and wherein said sleeve is disposed over said first member and said second member and wherein said second ends of said first member and said second member are disposed proximate said rear member of said sleeve and wherein said open front of said sleeve is disposed proximate said first ends of said first member and said second member; and (e) a lever attached to said sleeve, said lever adapted to pivot about an axis with respect to said first member and said second member; and (f) wherein said upper surface further comprises an upper opening extending across said upper surface having a longitudinal axis parallel to said axis of said lever.

* * * * *